US007739754B2

(12) United States Patent
Garneau

(10) Patent No.: US 7,739,754 B2
(45) Date of Patent: Jun. 22, 2010

(54) SEAT PAD FOR CYCLIST GARMENT AND METHOD OF MANUFACTURE

(75) Inventor: Louis Garneau, Saint-Augustin-de-Desmaures (CA)

(73) Assignee: Louis Garneau Sports Inc. (CA)

( * ) Notice: Subject to any disclaimer, the term of this patent is extended or adjusted under 35 U.S.C. 154(b) by 1394 days.

(21) Appl. No.: 10/812,730

(22) Filed: Mar. 29, 2004

(65) Prior Publication Data

US 2005/0210570 A1 Sep. 29, 2005

(51) Int. Cl.
*A41D 27/00* (2006.01)

(52) U.S. Cl. ..... 2/466; 2/455; 2/227; 2/228; 2/467; 2/215

(58) Field of Classification Search ..... 2/466, 2/455, 228, 227, 214, 467, 69, 215, 79, 238
See application file for complete search history.

(56) References Cited

U.S. PATENT DOCUMENTS 3,176,686 A * 4/1965 Barnes ..... 128/846
4,451,083 A * 5/1984 Marchello ..... 297/219.11
4,774,133 A * 9/1988 Doree et al. ..... 428/321.5
5,168,576 A * 12/1992 Krent et al. ..... 2/456
5,271,101 A * 12/1993 Speth et al. ..... 2/228
5,290,904 A 3/1994 Colvin et al.
5,366,801 A 11/1994 Bryant et al.
5,499,460 A 3/1996 Bryant et al.
5,637,389 A 6/1997 Colvin et al.
6,027,166 A * 2/2000 Yates ..... 297/195.1
6,393,618 B2 5/2002 Garneau
6,547,327 B1 * 4/2003 Yates ..... 297/214
6,565,702 B1 5/2003 Forsyth et al.
6,687,917 B2 * 2/2004 Forsyth et al. ..... 2/228
6,928,665 B1 * 8/2005 Yates ..... 2/466
2001/0052146 A1 12/2001 Garneau
2002/0029409 A1 * 3/2002 Coccia ..... 2/456
2003/0056282 A1 * 3/2003 Coccia ..... 2/466
2003/0163076 A1 * 8/2003 Lukens ..... 602/67
2004/0143890 A1 * 7/2004 Reschewitz ..... 2/466
2005/0066423 A1 * 3/2005 Hogan ..... 2/227
2005/0223478 A1 * 10/2005 Hogan ..... 2/466

FOREIGN PATENT DOCUMENTS

EP 0611330 1/1998
WO 9324241 12/1993

* cited by examiner

*Primary Examiner*—Gary L Welch
*Assistant Examiner*—Alissa J Tompkins
(74) *Attorney, Agent, or Firm*—Cantor Colburn LLP

(57) ABSTRACT

A seat pad for a cyclist garment, a method of manufacture thereof, and a cyclist garment including the same, are provided. The multi-layer seat pad includes an inner layer for contacting the cyclist, an outer layer for affixing to the garment, and a compressible, resilient middle layer disposed between the outer and inner layers, wherein the outer layer covers less than all of the inner layer.

41 Claims, 16 Drawing Sheets

SEAT PAD FOR CYCLIST GARMENT AND METHOD OF MANUFACTURE

FIELD OF INVENTION

The invention generally concerns cycling equipment and, more particularly, a seat pad for a cyclist garment and a method of manufacturing the same.

DESCRIPTION OF RELATED ART

Increased popularity of cycling, at both recreational and competitive levels, has resulted in a demand for high quality, low cost cycling apparel which is effective at providing the user with bodily comfort during sustained periods of cycling.

Particularly, considerable attempts have been made at developing a pant which provides the cyclist with increased comfort concerning contact of the body with the cycle seat. Typically, during cycling, a substantial portion of the cyclist's body weight bears on the cycle seat. Additionally, when peddling the cyclist's body undergoes considerable movement relative to the cycle seat resulting in frictional contact therebetween. Such weight bearing and prolonged frictional contact are known to cause certain discomforts including minor abrasions and, in some instances, more serious injuries suffered at the lower abdomen area of the cyclist.

Existing cyclist pants include multi-layered seat pads affixed to the inside crotch area of the pants. Such seat pads are designed to increase comfort by providing a padded buffer between the cyclist and the cycle seat during use. However, such known seat pads are often bulky and result in the unintended consequence of adding to the cyclist's discomfort upon the cycle seat. Particularly, chafing of the cyclist is prone to occur, specifically in the upper thigh area. Also, increased pressure may result on areas such as the inner thigh and crotch regions as a result of the bulky seat pads. Further, such seat pads are known to be less flexible than desired, thus increasing discomfort of the cyclist. Additionally, these known seat pads do not provide suitable ventilation to the cyclist in the area of contact with the seat. Thus, perspiration and/or heat may accumulate, further adding to the cyclist's overall discomfort.

Accordingly, a seat pad, and a cyclist garment including the same, which provide effective padding against contact with the cycle seat, increased flexibility, and proper ventilation to the lower abdomen area of the cyclist, are desired.

BRIEF SUMMARY OF INVENTION

The invention provides a multi-layer seat pad for a cyclist garment, comprising an inner layer for contacting the cyclist, an outer layer for affixing to the garment, and a compressible, resilient middle layer disposed between the outer and inner layers, where the outer layer covers less than all of the inner layer.

The invention further provides a cycling garment, comprising a crotch portion to be worn proximate a crotch area of a cyclist, a multi-layer seat pad disposed at the crotch portion for engaging the crotch area of the cyclist, the seat pad including an inner layer for contacting the cyclist, an outer layer for affixing to the garment, and a compressible, resilient middle layer disposed between the outer and inner layers, wherein the outer layer covers less than all of the inner layer.

A method of manufacturing a multi-layer seat pad for a cyclist garment, is also taught herein, the method comprising, forming an inner layer for contacting the cyclist, forming a compressible, resilient middle layer, affixing the middle layer on the inner layer, forming an outer layer for affixing to the garment, affixing the outer layer on the inner layer over the middle layer such that the outer layer covers less than all of the inner layer.

The invention further provides a seat pad for a cyclist garment, comprising an inner layer for contacting a cyclist, and a compressible, resilient layer bonded to the inner layer, where the compressible resilient layer covers less than all of the inner layer and the bonded inner layer and compressible, resilient layer are fixed to the cyclist garment.

Additionally, a seat pad for a cyclist garment is disclosed, the seat pad including a first side, an opposing second side, and perforations formed through the seat pad so as to traverse from the first side to the second side.

Still further, the invention provides a multi-layer seat pad for a cyclist garment, comprising an inner layer for contacting the cyclist, an outer layer for affixing to the garment, and a compressible, resilient middle layer disposed between the outer and inner layers, where the middle layer includes a thermal control material having thermal energy storage and insulative properties.

BRIEF DESCRIPTION OF THE DRAWINGS

Referring now to the drawings wherein like elements are numbered alike in the several FIGURES.

DETAILED DESCRIPTION OF INVENTION

Figure 1:
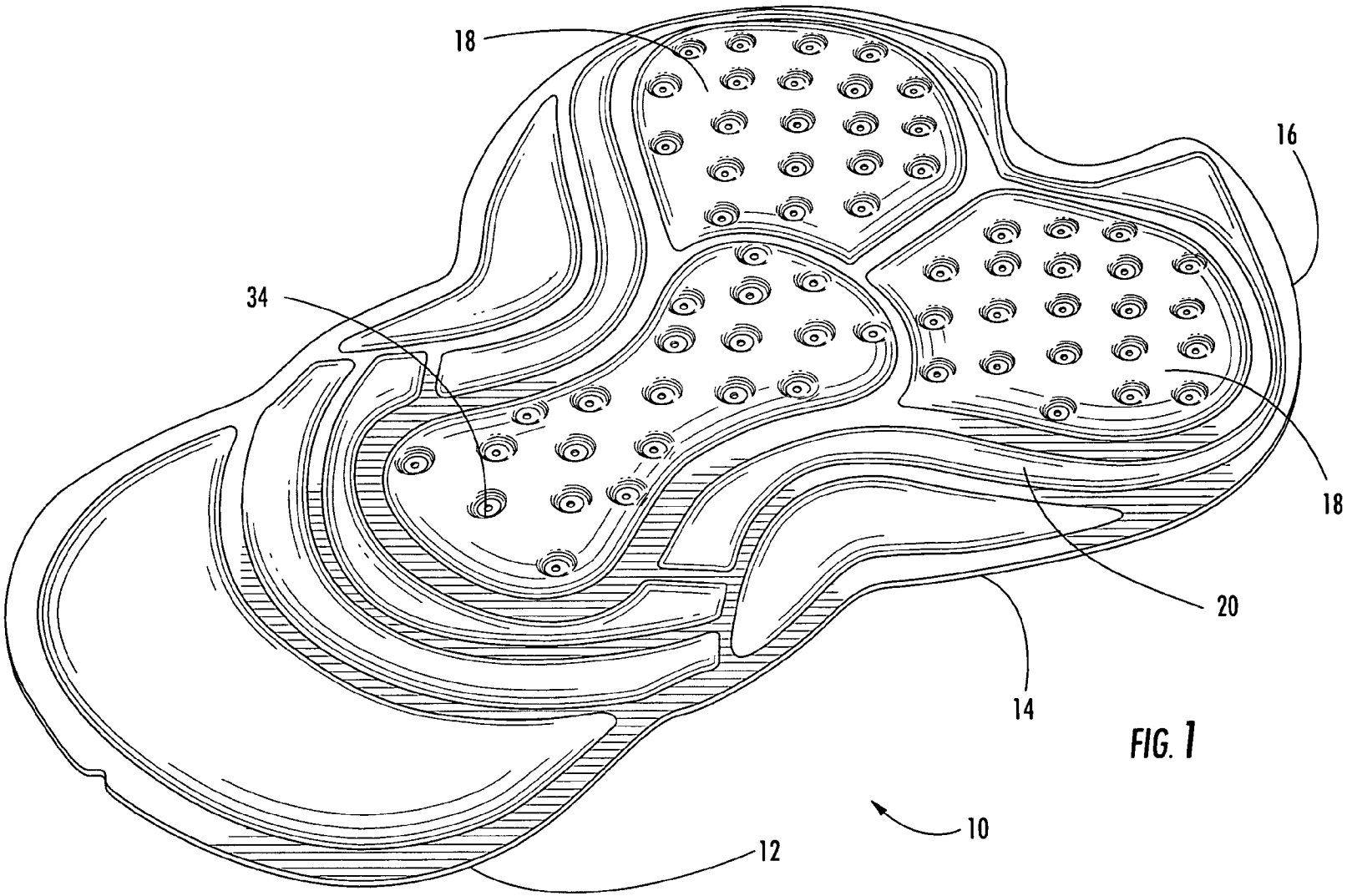
FIG. 1 is a perspective view of a cyclist seat pad, in one embodiment of the invention.
Figure 2:
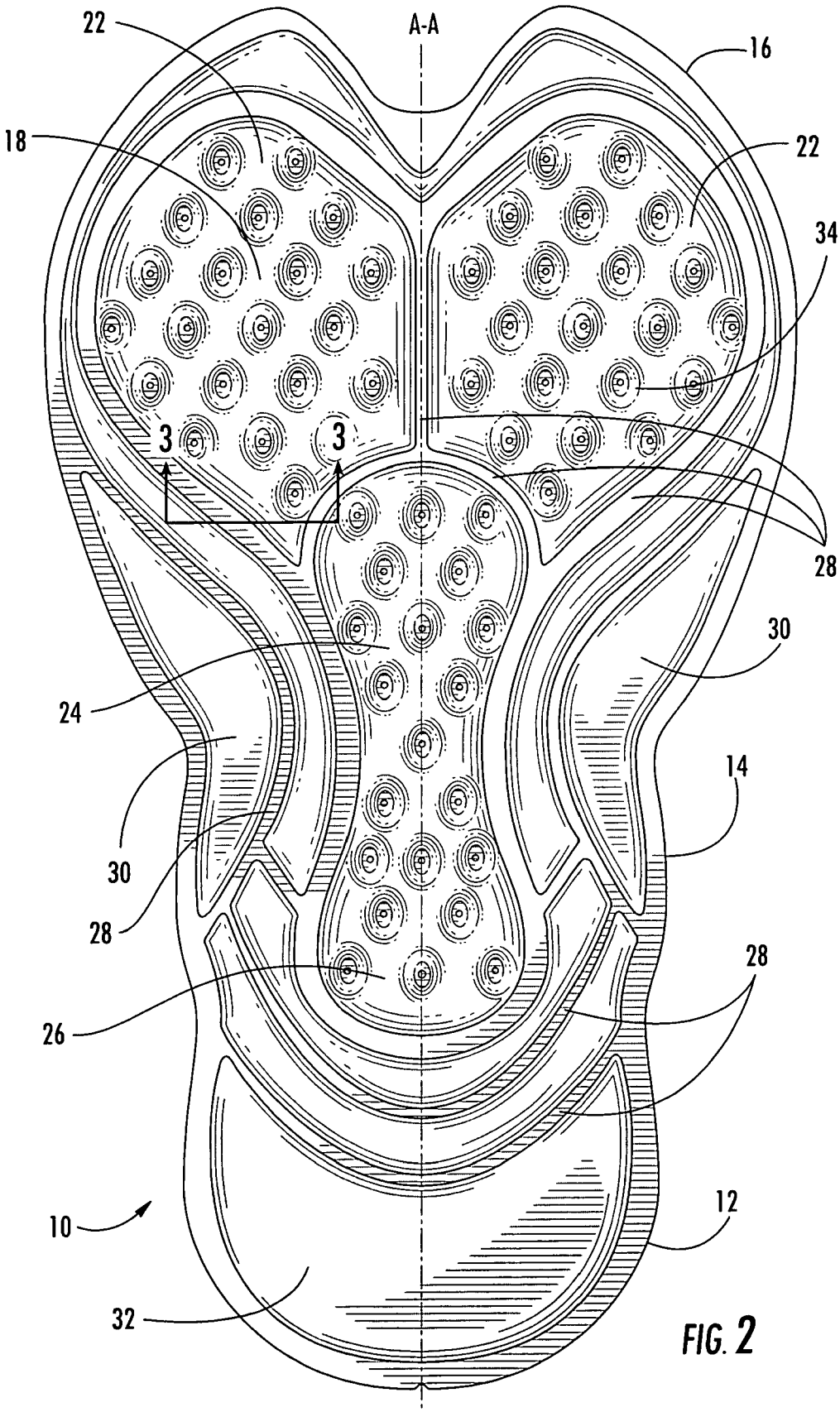
FIG. 2 is a top plan view thereof.

FIGS. 1-4 show various views of a cyclist seat pad 10, in one exemplary embodiment of the invention. The seat pad 10 is generally a padded, multi-layered substantially planar element intended to be disposed in a cycling garment for providing a male cyclist with enhanced comfort while sitting upon and riding a bicycle or the like.

The seat pad includes a front portion 12, an opposing rear portion 16, and an intermediate portion 14 disposed between the front and rear portions 12 and 16, respectively. The front portion 12 is generally U-shaped and is designed to contact and support the lower abdominal region of the cyclist. The rear portion 16 of the seat pad 10 is somewhat heart-shaped and is substantially wider than the front portion 12. The rear portion 16 is generally oriented to align with the buttocks region of the cyclist. The intermediate portion 14 serves to connect the front and rear portions 12 and 16, respectively, and includes curvilinear contouring along sides thereof. When the seat pad is properly utilized by the cyclist, the intermediate portion 14 contacts the crotch and upper thigh regions thereof.

A central padded area 18 is disposed centrally on the seat pad 10 about a longitudinal axis A-A. (See, FIG. 2.) The central padded area 18 extends from the rear portion 16, through the intermediate portion 14, towards the front portion 12. The seat pad 10 further includes an outer area 20 which extends substantially around a periphery of the central padded area 18. The central padded area 18 includes padding, as discussed further herein, and is substantially thicker than the outer area 20, as particularly evident in FIG. 3. The outer area 20 may include padding similar to that of the central padded area 18 or, alternatively, the outer area 20 may be relatively flat, or have differing degrees of padding.

The central padded area 18 includes a buttocks portions 22 disposed and designed for contact with the buttocks of the cyclist. The central padded area 18 further includes a crotch portion 24 extending centrally from the buttocks portions 22 along the axis A-A into the intermediate portion 14 of the seat pad 10. The crotch portion 24 is intended for contact with the crotch area of the cyclist, that is, the region generally between the legs. The central padded area 18 terminates toward the front portion 12 of the seat pad 10 at a perineum portion 26 particularly designed for contact with the perineum region of the cyclist.

Figure 3:
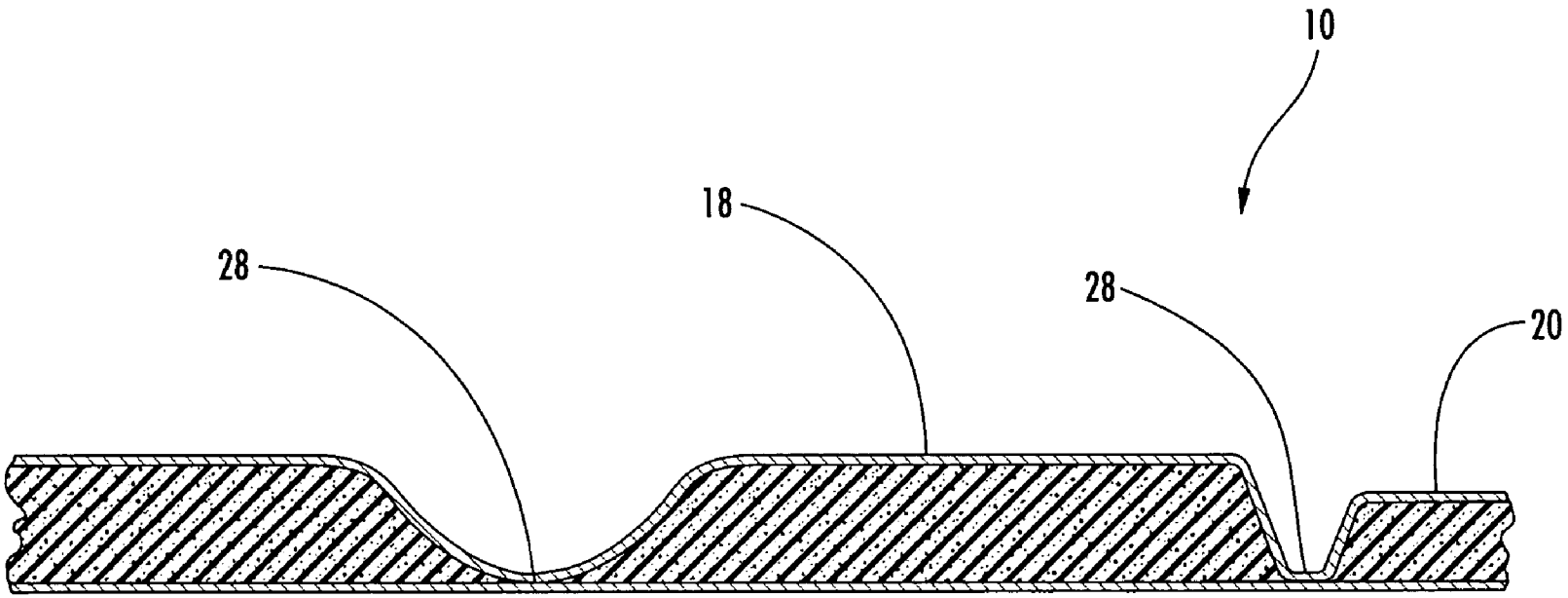
FIG. 3 is an enlarged partial cross-sectional view thereof, taken along line 3-3 of FIG. 2.
Figure 4:
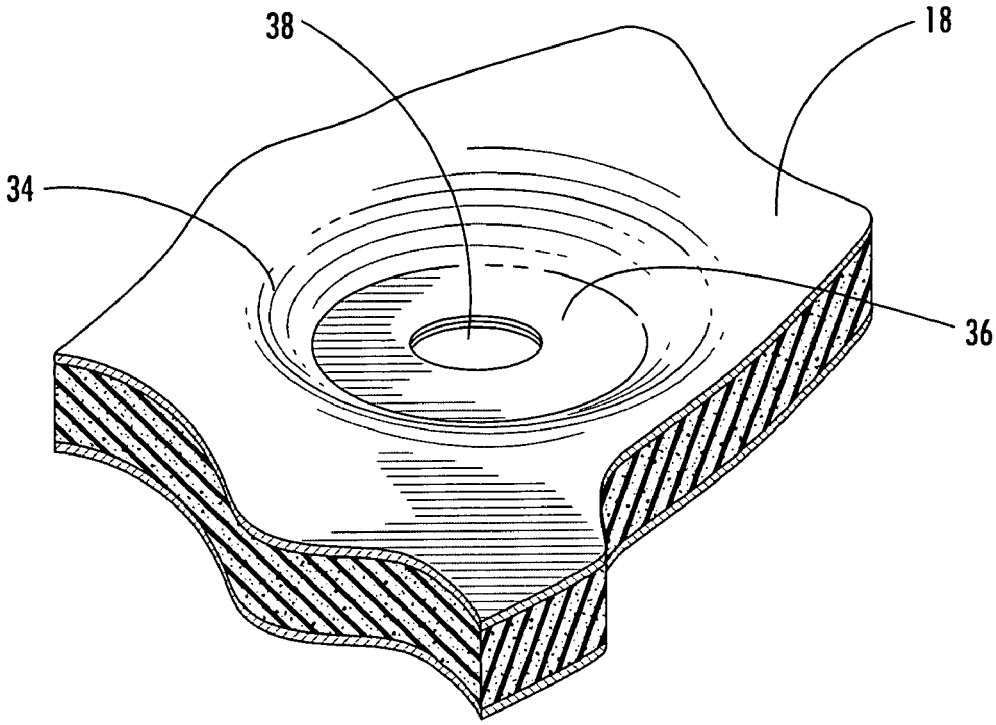
FIG. 4 is an enlarged perspective view of a portion of the cyclist seat pad of FIG. 1 showing a perforation thereof.

Thinned hinge lines 28 separate the buttocks portions 22 from one another and separate the buttocks portions 22 from the crotch and lower abdominal portions 24 and 26, respectively. The thinned hinge lines 28 are portions of the seat pad 10 having a reduced thickness, as best shown in FIG. 3. The thinned hinge lines 28 allow an area of the seat pad 10 to pivot, or otherwise move, relative to another portion. Additional thinned hinge lines 28 traverse a perimeter of the central padded area 18 separating the same from the outer area 20. Further thinned hinge lines 28 extend across the outer area 20.

While the thinned hinged lines 28 are described herein and throughout with regard to specific dispositions thereof on the seat pad 10, this is in no way intended to limit the scope of the formation and the positioning of the hinge lines 28. As mentioned, such lines 28 provide the seat pad with an advantageous degree of flexibility. Accordingly, the thinned hinge lines 28 may be disposed at any position on the seat pad 10 as desired to provide enhanced flexibility thereto and/or to bring any additional advantages thereof to the seat pad of the invention.

The outer area 20 extends around the central padded area 18, as mentioned, and includes upper thigh portions 30 disposed generally at the intermediate portion 14 of the seat pad 10, adjacent the crotch portion 24 of the central padded area 18. The upper thigh portions 30 are intended for contact with the upper thigh areas of the cyclist. A lower abdominal portion 32 of the outer area 20 extends toward the front 12 of the seat pad 10. The lower abdominal portion 32 of the outer area 20 combines with the perineum portion 26 of the central padded area 18 to provide additional support and padding to the cyclist's lower abdominal area.

Thinned hinge lines 28 extend along the upper thigh portions 30 and between said portions and the lower abdominal portion 32 to provide increased flexibility and added comfort.

The seat pad 10 further includes a plurality of perforations 34 formed, preferably, in the central padded area 18. The perforations 34 extend entirely through the seat pad 10 to provide ventilation to the central padded area 18 during use of the seat pad 10. Such ventilation cools the cyclist while using the seat pad 10 and enables moisture evacuation to keep the cyclist dry. Additionally, the perforations 34 reduce the overall weight and size of the seat pad 10 and provide increased flexibility thereof, thus enhancing comfort to the cyclist.

Each of the plurality of perforations 34 includes a recess 36 comprising a substantially circular part of the central padded area 18 having a reduced thickness. See FIGS. 1-3 and, particularly, FIG. 4. Each perforation 34 further includes a hole 38 formed at the recess 36 and extending entirely through the seat pad 10. The recesses 36 are larger than the corresponding holes 38. Thus, the holes 38 are resultantly seated at a substantially planar base of the recesses 36, such that the holes 38 are surrounded by a portion of the reduced thickness part of the central padded area 18 which forms the recess 36. That is, the holes 38 are inset into the central padded area 18 and surrounded by a reduced thickness portion of the central padded area 18.

The recesses 36 are formed by permanently compressing the central padded area 18 to obtain the desired reduced thickness thereof. The compression is achieved by heat treatment or, more preferably, by a high frequency fusion treatment. The holes 38 are then cut or, more preferably, die punched through the reduced thickness portion of the central padded area 18 at the recesses 36.

The recesses 36 may be formed on an upper surface of the seat pad 10 so as to contact the body of the cyclist. The holes 38, as described, are inset into theses recesses 34. Additional recesses may be formed on the opposite side of the seat pad 12, that is, the side of the seat pad which is affixed to the garment. The recesses on this lower side are formed so as to correspond with the recesses of the upper surface such that the respective holes traverse from a recess at the upper surface through the seat pad to a recess at the lower surface.

The inset configuration of the holes 38 is advantageous in several respects. Firstly, the permanently compressed nature of the recesses 36 expedite formation of the holes 38 through the seat pad 10. That is, the holes 38 may be easily and consistently punched through the compressed first pad area 18 at the recesses 36 without encountering difficulties inherent in punching or cutting the non-compressed, fully formed, thick padded material prevalent at the central padded area 18. Secondly, the compressed central padded area 18 resists tearing proximate the holes 38 during formation thereof and during subsequent use of the seat pad 10 by the cyclist.

Additionally, the inset feature of the holes 38 serves to prevent blockage thereof during use of the seat pad 10. As noted above, a particular recess 36 is larger in area than the corresponding hole 38. Thus, due to the larger size of the recesses 36, the cyclist's body may contact a portion of one of the recesses 36 while another portion of the same recess 36 remains open, thus providing a direct pathway to the corresponding hole 38 for ventilation. Even if, during use of the seat pad 10, the cyclist's body fully contacts and entirely covers a recess 36, the material of the central padded area 18 may serve to support the cyclist above the particular hole 38. That is, while the recess 36 may be covered, the corresponding hole 38 remains open and capable of allowing ventilation of an interior of the recess 36 and of a region of the central padded area 18 proximate the recess 36.

Figure 5:
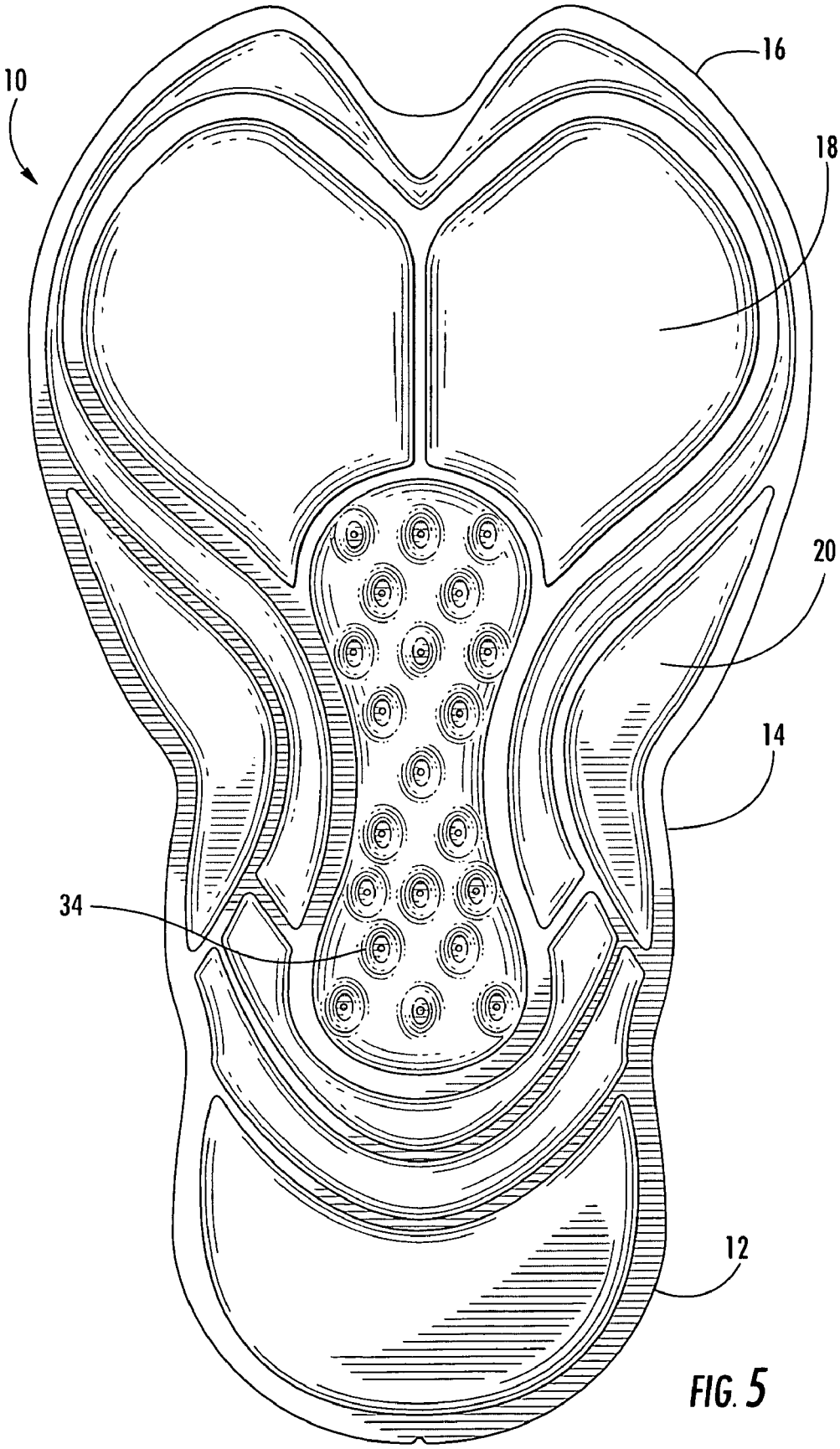
FIG. 5 is another top plan view of the cyclist seat pad.
Figure 6A:
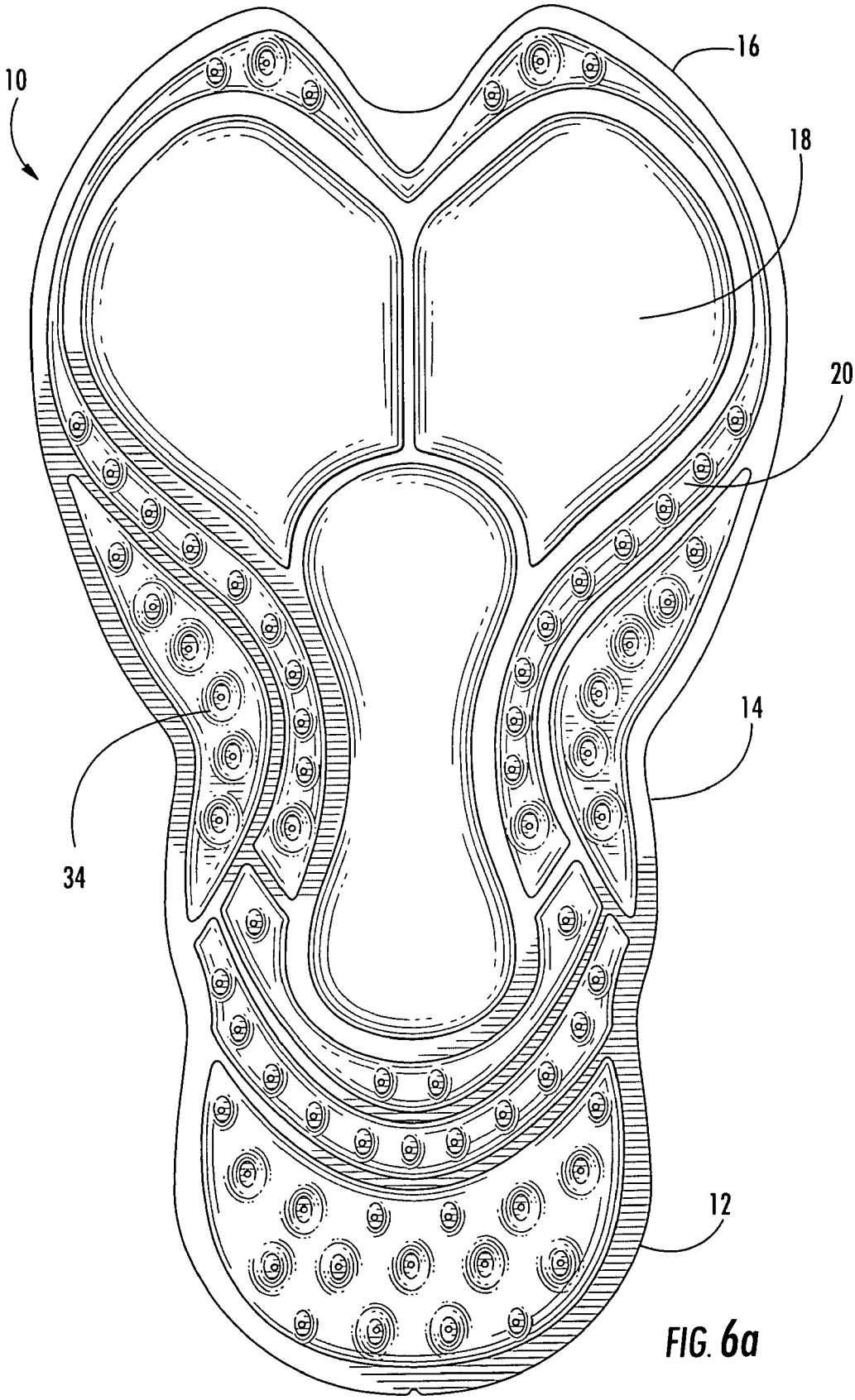
FIGS. 6*a* and 6*b* are additional top plan views of cyclist seat pad.
Figure 6B:
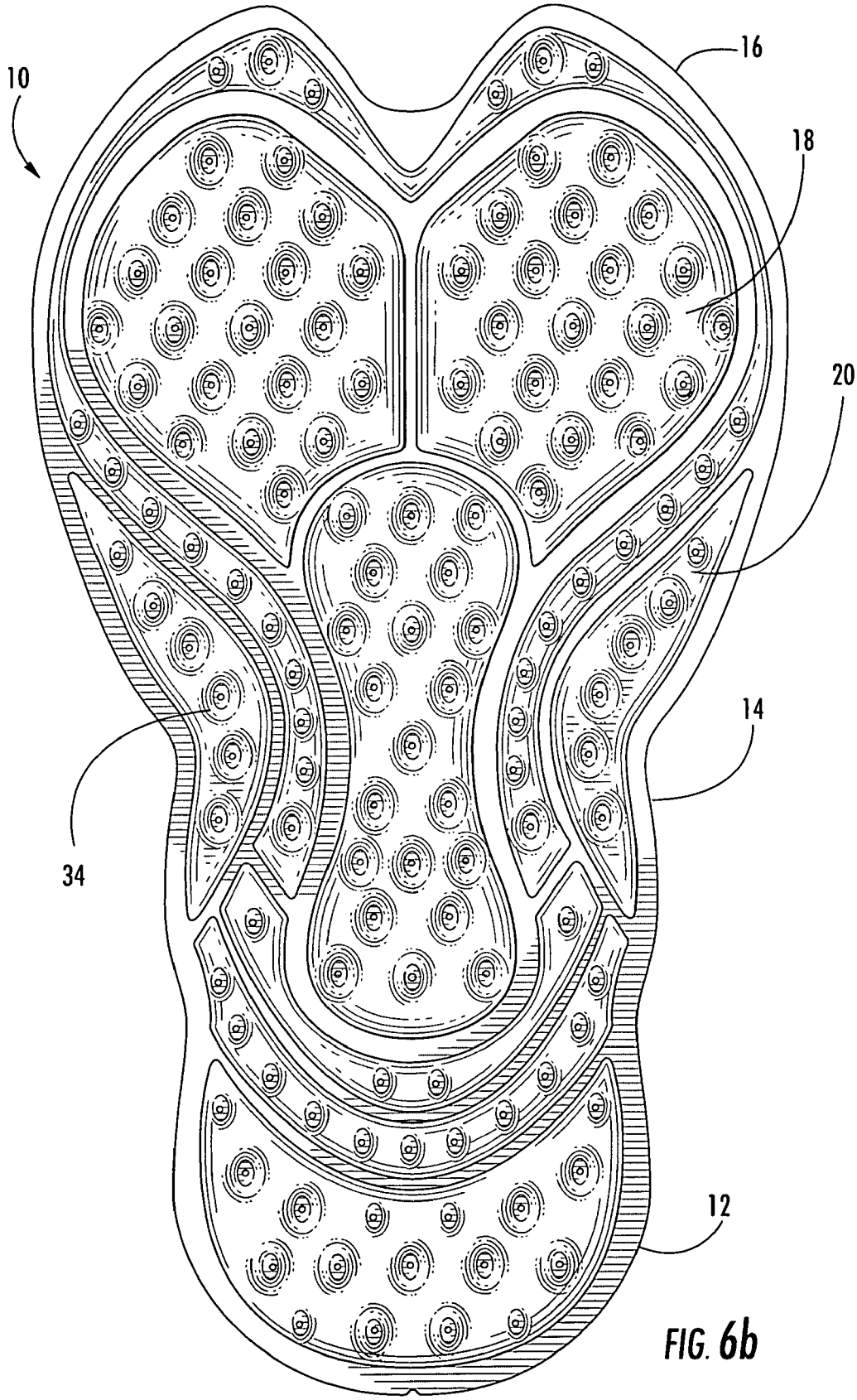

Further embodiments of the invention contemplate the perforations 34 as formed on only a portion of the central padded area 18. See, FIG. 5. Additionally and/or alternatively to the embodiments of the seat pad thus far disclosed, the perforations 34 may be formed on at least a portion of the outer area 20 as shown, for example, in FIGS. 6*a*, 6*b*. Perforations 34 formed on the outer area 20 include the recesses 36 comprising permanently compressed, reduced thickness areas of the outer area 20 having holes 38 formed therein, similar to that described above with reference to the central padded area 20. Alternatively, the perforations 34 may be formed directly in the outer area 20 without establishing a permanently compressed portion thereof.

The perforations 34 may be disposed regularly across the surface of the central padded area 18 and/or the outer area 20. Alternatively, the perforations may be disposed randomly or in predetermined concentrated groupings across the first and/or outer portions 18 and 20, respectively.

Preferably, the perforations 34 include recesses 36 of substantially circular shape and having a diameter of approximately four to seven millimeters. The respective holes 38 are also generally circular in shape and include a preferable diameter of approximately one to three millimeters. Perforations 34 disposed in the central padded area 18 include a preferred recess depth of approximately eight to ten millimeters. Perforations 34 disposed in the outer area 20 include a preferred recess depth of approximately five to seven millimeters. Here, the recess depth is defined as a distance from an uncompressed area of the respective padded area 18 or 20 to the permanently compressed portion of the padded area 18, 20 at the recess 36.

Figure 7:
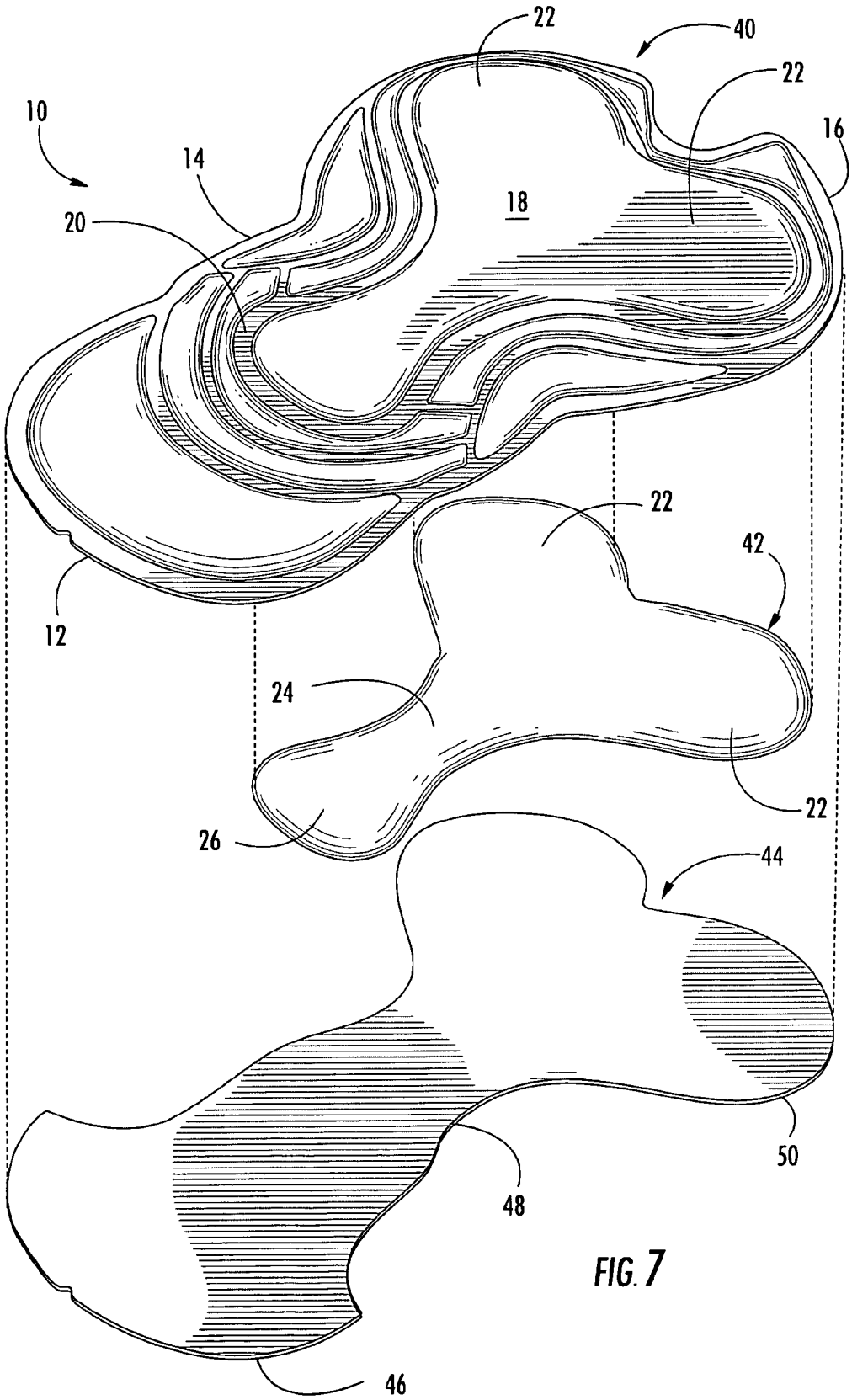
FIG. 7 is a perspective, exploded view of the cyclist seat pad of FIG. 1 showing the multiple layers thereof.

As mentioned, the seat pad 10 is a multi-layered element. FIG. 7 shows an exploded perspective view of the seat pad 10 revealing the various layers. As shown therein, the seat pad includes an inner layer 40, a middle layer 42, and an outer layer 44. The inner layer 40 contacts the body of the cyclist during use of the seat pad 10, the outer layer 44 is fixed to a cycling garment opposite the body of the cyclist, and the middle layer 42 is disposed between the inner and outer layers 40 and 44, respectively.

While various individual layers of the seat pad 10 are herein specified, this description is only exemplary and is not intended to limit or otherwise narrow the invention. The seat pad may include any number of layers in any potential combination thereof as desired for achieving the comfort properties and padding provided by the seat pad. Further, it shall be understood that the layers composing the seat pad may individually be formed of a uniform, monolithic material construction or, alternatively, such layers may themselves be composed of a plurality of material layers. Thus when describing and reciting "a layer" of the seat pad herein, any of these constructions are contemplated, as well as combinations and variations thereof.

The inner layer 40 is composed of a cloth-like material. That is, the inner layer comprises a thin, generally non-compressible, woven fibrous material formed of, for example, a polyester, or more preferably a brushed micro-fiber polyester. The inner layer comprises a thickness of approximately 0.2 to 4.0 millimeters and, most preferably, approximately 0.3 to 2.0 millimeters. In a preferred embodiment, the inner layer 40 further includes an antibacterial finish disposed on or in the surface of the layer 40 which contacts the body of the cyclist.

The middle layer 42 is composed of a thick compressibly resilient open-cell foam, such as polyurethane or another "air breathing" material. The middle layer 42 includes a thickness of approximately ten to fifteen millimeters, and most preferably, approximately twelve millimeters.

Figure 8:
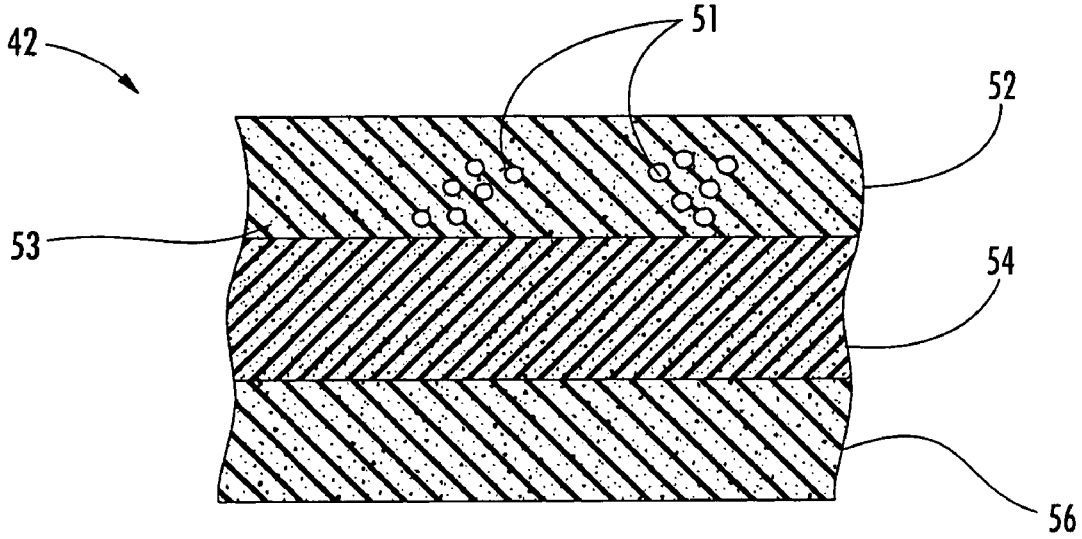
FIG. 8 is an enlarged, partial cross-sectional view of one of the layers shown in FIG. 7.

In a preferred embodiment of the seat pad 10, as shown in FIG. 8, the foam padding material composing the middle layer 42 comprises a plurality of layers. Specifically, the middle layer 42 includes a first layer 52 disposed at an upper side of the layer 52 proximate the inner layer 40. The first layer 52 comprises a padding material, such as a foam, which is designed to readily absorb and release heat from the body of the cyclist as desired and provide antibacterial protection to the cyclist.

In a preferred embodiment, the first layer 52 comprises a thermal control material having thermal energy storage and insulative properties for use as a thermal barrier between a heat source and a heat sink. The thermal control material of the first layer 52 preferably comprises a foam base 53 forming an insulative pad and a plurality of microcapsules 51 dispersed throughout the foam base 53 containing a phase change material. The foam base material 53 comprises any suitable, open or closed cell, moldable foam such as foamed organic plastic, etc. The microcapsules 51 may be composed of a plastic and the phase change material contained therein comprises, for example, eicosane, plastic crystals (e.g., 2,2-dimethyl-1,3-propanediol [DMP]), paraffinic hydrocarbons, etc. For example, the first layer 52 may comprise a material commercially available under the U.S. Registered Trademark, "Comfortemp DCC" and/or as described in U.S. Pat. Nos. 5,290,904, 5,366,801, 5499460, 5637389 and/or European Patent No. EP 0611330, and/or International Patent Application No. PCT/US93/05119, all of which said patents and applications are incorporated herein by reference in their entirety.

The first layer 52 generally includes a thickness of approximately less than ten millimeters. More preferably, the thickness of the first layer 52 is approximately four millimeters. These thickness, or course, are merely exemplary, and refer generally to the present illustrative embodiment of the first layer 52. The thickness of the first layer 52 may be greater or less than these approximations and, further, may vary across the first layer 52, i.e., various portions of the layer 52 may include different thicknesses. Moreover, the amount of thermal control material provided in the first layer 52 may be varied throughout the layer as desired. Additionally, while the first layer 52 is herein described as a generally homogenous single layer, the invention contemplates the first layer 52 comprising a plurality of sub-layers. For example, the first layer 52 may comprise two or more sub-layers of the above-described thermal control material. Also, the first layer 52 may only comprise a simple foam for provided padding to the cyclist, or the layer 52 may only comprise the discussed thermal control material, or the layer 52 may comprise both the simple foam and the thermal control material without any limitation of quantity, thickness, etc. of either product.

The middle layer 42 further comprises a second layer 54 disposed on an underside of the first layer 52, that is, opposite the inner layer 40. The second layer 54 is composed of a resilient, compressible foam designed to provide the cyclist with both padding comfort and support. The foam of the second layer 54 is most preferably composed of a Polyurethane expanded polyester base having a density of about 20.0 and a thickness of approximately less than ten millimeters. More desirably, the thickness of the second layer 54 is approximately five millimeters. It is herein noted that the middle layer 54 is described above and shown in FIG. 8 as being disposed at the underside of the first layer 52. This, of course, is only an exemplary configuration of the middle layer 42. The invention contemplates the second layer 54 being disposed atop the first layer 52 or in any other desirable position relative the first layer 52.

The middle layer 42 additionally includes a third layer 56 disposed beneath the second layer 54 proximate the outer layer 44. The third layer 56 is composed of a resilient, compressible foam designed to provide the cyclist with padding comfort, support, and moisture absorption. The foam of the third layer 56 is most preferably composed of a Polyurethane expanded polyester base having a density of about 90 and a thickness of approximately less than ten millimeters. More desirably, the thickness of the third layer 56 is approximately three millimeters.

The various first, second, and third layers 52, 54, and 56 are fused or bonded or otherwise adhered together to form the middle layer 42 of the seat pad 10. Returning to FIG. 7, the middle layer 42 includes a shape which corresponds substantially to the central padded area 18, described above. That is, the middle layer 42 includes the buttocks portions 22, the crotch portion 24, and the perineum portion 26 described above with reference to FIGS. 1-2. The middle layer 42, however, is substantially smaller than the inner layer 40 and, as discussed, includes a different shape than that of the inner layer 40. That is, the middle later 42 does not complement the inner layer 40.

This being said, the invention contemplates embodiments wherein one or several of the first, second, and third layers 52, 54, 56 of the middle layer 42 extend beyond the limits of the central area 18 of the inner layer 40. For example, the first layer 52 may extend so as to overlap the outer area 20, partially or entirely, when the middle layer 42 is fixed together with the inner layer 40.

The outer layer 44 is composed of a cloth-like material. That is, the outer layer 44 comprises a thin, generally non-compressible, woven fibrous material formed of a synthetic polymer, preferably a polyamide, for example a nylon. The outer layer 44 comprises a thickness of approximately 0.2 to 2.0 millimeters and, most preferably, approximately 0.3 to 1.0 millimeters.

The outer layer 44 is smaller in area than the inner layer 40, but is generally larger than the middle layer 42. For example, the outer layer 44 may include a total surface area that is between fifty and ninety percent of a total surface area of the inner layer 40. Further, the surface area of the outer layer 44 may be between sixty and eighty percent of the total surface area of the inner layer 40. Still further, the outer layer 44 surface area may be seventy to eighty percent of the inner layer 40 surface area. Moreover, the surface area of the outer layer 44 may be approximately seventy-five percent of the surface area of the inner layer 40.

Additionally, the outer layer 44 includes an elongated shape different from the shapes of both the inner and middle layers 40 and 42, respectively. Thus, the outer layer 44 does not complement the inner layer 40 nor the middle layer 42. See particularly, FIGS. 7 and 9*a*. Specifically, the outer layer 44 includes a first end 46 and an opposing second end 50. The outer layer 44 preferably tapers inward slightly at a neck portion 48 giving the outer layer 44 a substantially hourglass-like shape.

Figure 9A:
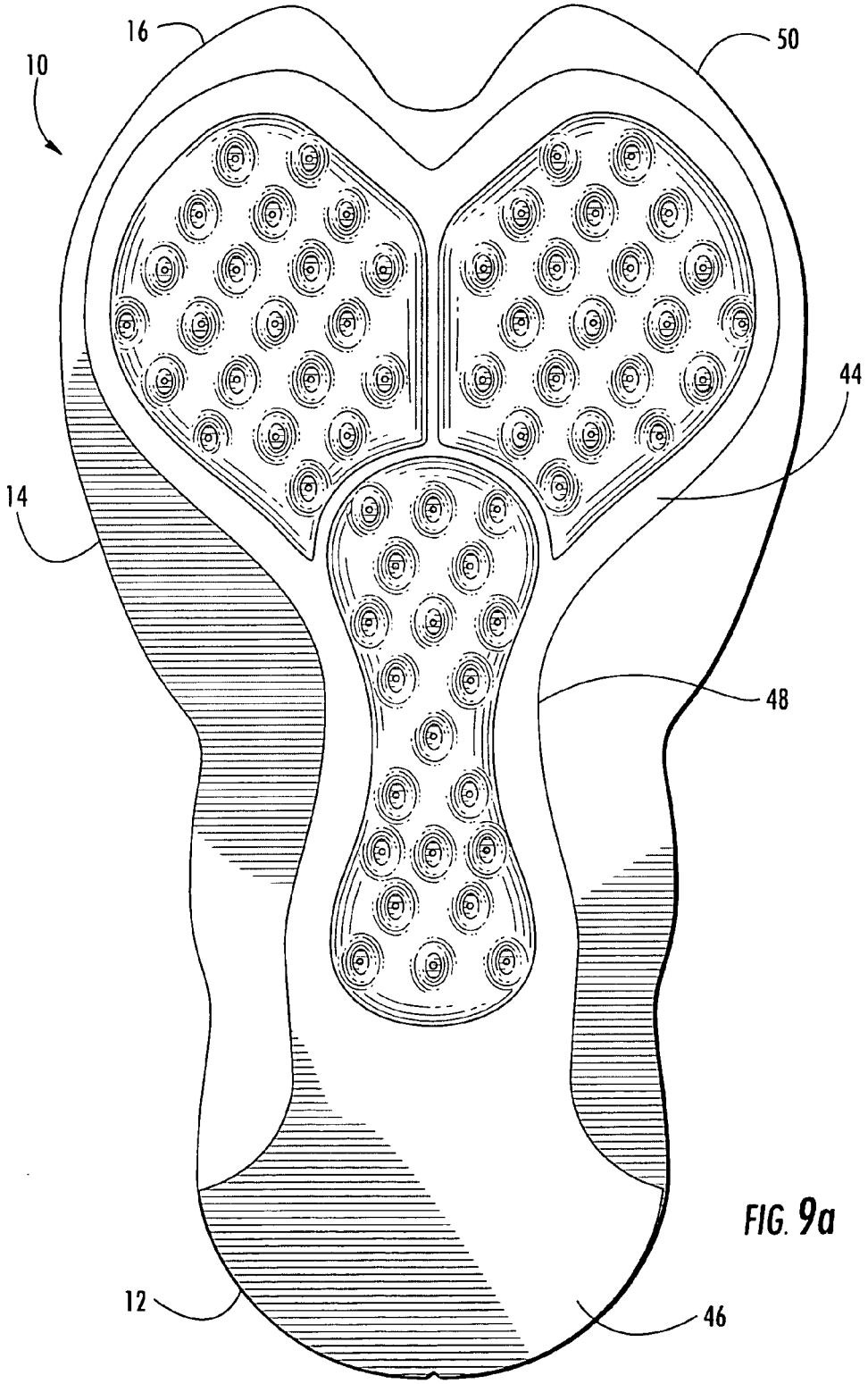
FIG. 9*a* is bottom plan view of the seat pad in one embodiment of the invention.
Figure 9B:
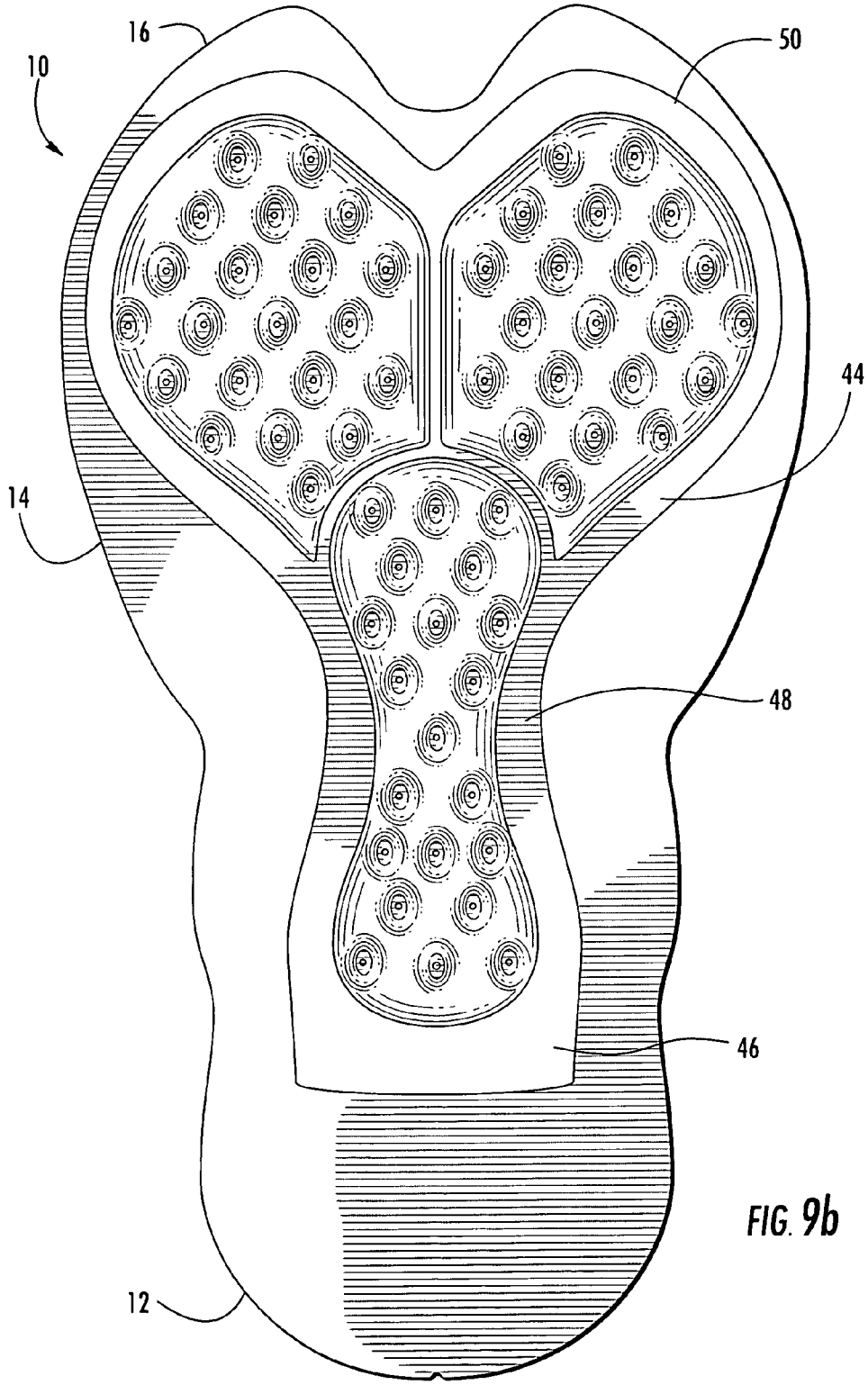
FIG. 9*b* is a bottom plan view of the seat pad in another embodiment of the invention.

In one embodiment, as shown in FIG. 9*a*, the first end 46 of the outer layer 44 extends toward and meets the edge of the front portion 12 of the seat pad 10. However, in another embodiment, as shown in FIG. 9*b*, the first end 46 of the outer layer terminates short of, and does not meet, the edge of the front portion 12.

It is particularly noted that the outer layer 44 possesses a somewhat hourglass-like shaped, as mentioned above. This shape is provided by the wider first end 46, the even wider opposing second end 50, and the more narrow neck portion 48 disposed therebetween. The neck portion 48 substantially corresponds to the crotch and perineum portions 24, 26 of the central area 18 described hereinabove. That is, the neck portion 48 (as well as the first and second ends 46, 50) does not extend into the region of the pad 10 defined as the upper thigh portions 30 of the outer area 20, discussed hereinabove. The resulting pad 10 includes thin upper thigh portions 30 thus reducing bulkiness and enhancing comfort. See further discussion below.

The inner layer 40, the middle layer 42, and the outer layer 44 are fixed together to form the multi-layered seat pad 10. The various layers 40, 42, 44 are fixed together in any sufficient manner which establishes a lasting bond therebetween. For example, the layers may be temperature bonded, high frequency fusion bonded, affixed together by use of an ultrasound gun, adhered together with an adhesive such as a glue, etc. During this bonding process the materials of the various layers may be compressed or otherwise made smaller as desired to achieve a final seat pad 10 a specific thickness. For example, inner, middle, and outer layers 40, 42, and 44 having original thicknesses of one millimeter, twelve millimeters, and one millimeters, respectively, may be compressed or reduced to form into the seat pad 10 having a maximum thickness of approximately ten millimeters or less.

The seat pad 10 fabricated as discussed above, includes a plurality regions having distinct thicknesses due to overlapping or non-overlapping of the inner, middle, and outer layers 40, 42, and 44. That is, due to the varying shapes and sizes of the layers composing the seat pad 10, some areas of the pad 10 include all three layers overlapped and thus include a maximum thickness, while other areas of the pad do not include all of the layers overlapped upon each other and thus these areas include a reduced thickness.

The portion of the pad 10 indicated by the central region 18 comprises all three inner, middle, and outer layers 40, 42, and 44 laminated together as discussed herein. The central region 18 generally includes a thickness of approximately five to fifteen millimeters. More preferably, the buttocks portion 22 of the central region 18 includes a thickness of approximately ten millimeters and the crotch and perineum portions 24, 26 include a thickness of approximately eight millimeters. The materials composing this region of the pad (the properties of which are discussed above), and the construction thereof, provide the cyclist with sufficient support, enhanced padding against shock and impact, increased flexibility, temperature control, and moisture absorption and evacuation.

A substantial portion of the weight of the cyclist bears on the cycle seat at the central area 18, thus enhanced support and padding is focused in this region. Such enhanced support and padding is specifically disposed at and tailored tightly to the central area 18 and does not extend into the outer area 20 where the extra bulk thereof could interfere with movement of the cyclist's body, thus resulting in discomfort to the cyclist.

The region of the seat pad 10 indicated by the outer area 20 comprises less than all of the inner, middle, and outer layers 40, 42, and 44. In a preferred embodiment, this outer area is composed of only the inner layer 40, that is, the middle and outer layers 42 and 44 do not extend to the outer area 20. See FIGS. 9*a* and 9*b*. In another embodiment of the seat pad 10, a thin foam padding portion of the middle layer 42 extends from the central area 18 into the outer area 20 to provide a degree of padding and support to the cyclist. Still, in such embodiment of the seat pad 10, the outer area 20 is substantially thinner than the central area 18.

More particularly, the outer area 20 includes an overall thickness of approximately two to eight millimeters and, more particularly, includes a thickness of approximately three millimeters. In a preferred embodiment, the lower abdominal portion 32 of the outer area 20 has a slightly increased thickness of, for example, approximately four to eight millimeters and, more preferably, includes a thickness of approximately six millimeters.

The outer area 20 is designed to provide sufficient support to the cyclist as well as padding against impact with the cycle seat. However, as discussed, the outer area 20 is formed generally thinner than the central area 18 to reduce an overall bulkiness of the seat pad 10, thus providing a lighter-weight, more flexible and, hence, more comfortable seat pad. It is particularly noted that the upper thigh portions 30 are preferably a mere three millimeters in thickness, less than half the preferred thickness of the central area 18. In this way, maximum support and padding is provided to the cyclist where such is needed the most, in the region designated by the central area 18, while the other areas, particularly, the upper thigh portions 30, remain thin thus providing the user with a full unobstructed range of movement in this region.

Figure 10:
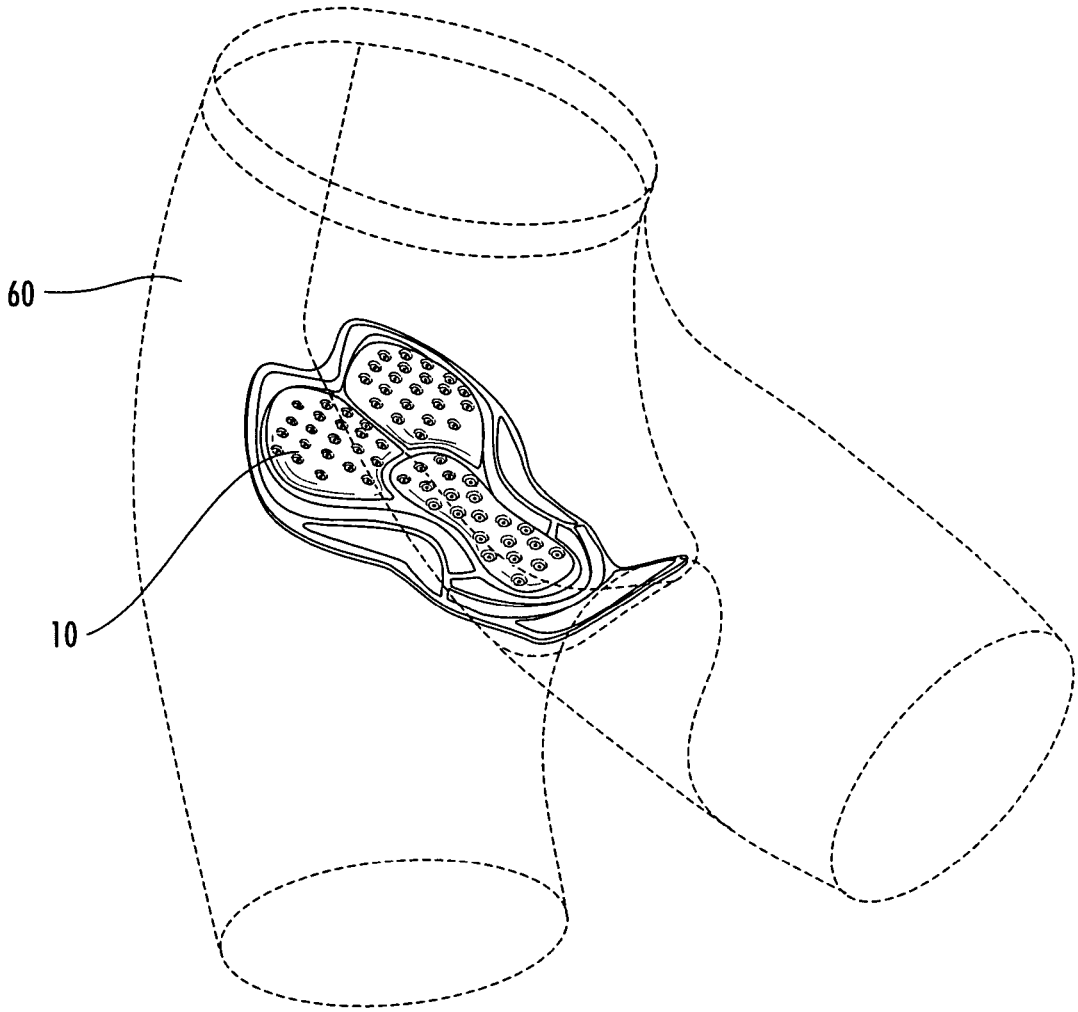
FIG. 10 is a perspective view of the seat pad disposed in a cycling garment.

The seat pad 10 is preferably fixed to a cycling garment 60 as shown in FIG. 10. The garment 60 comprises any clothing item to be worn by the cyclist proximate the groin and crotch area such as, for example, cycling pants, shorts, underwear, etc. The seat pad 10 is fixed to the cycling garment 60 by any suitable method including, but not limited to, stitching, temperature or fusion bonding, adhering with a bonding agent, etc., and any combination thereof.

Figure 11:
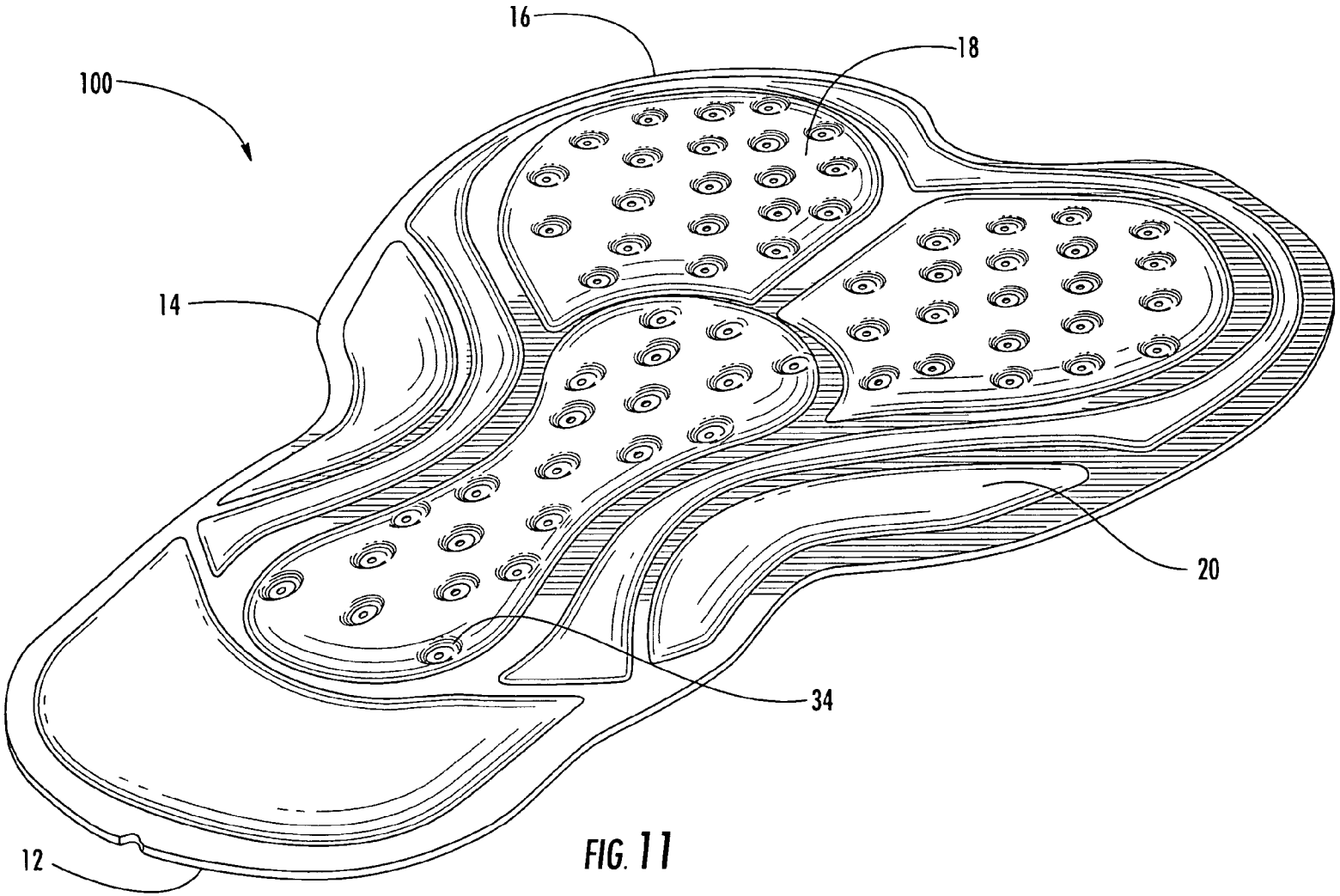
FIG. 11 is a perspective view of a seat pad in another exemplary embodiment of the invention.
Figure 12:
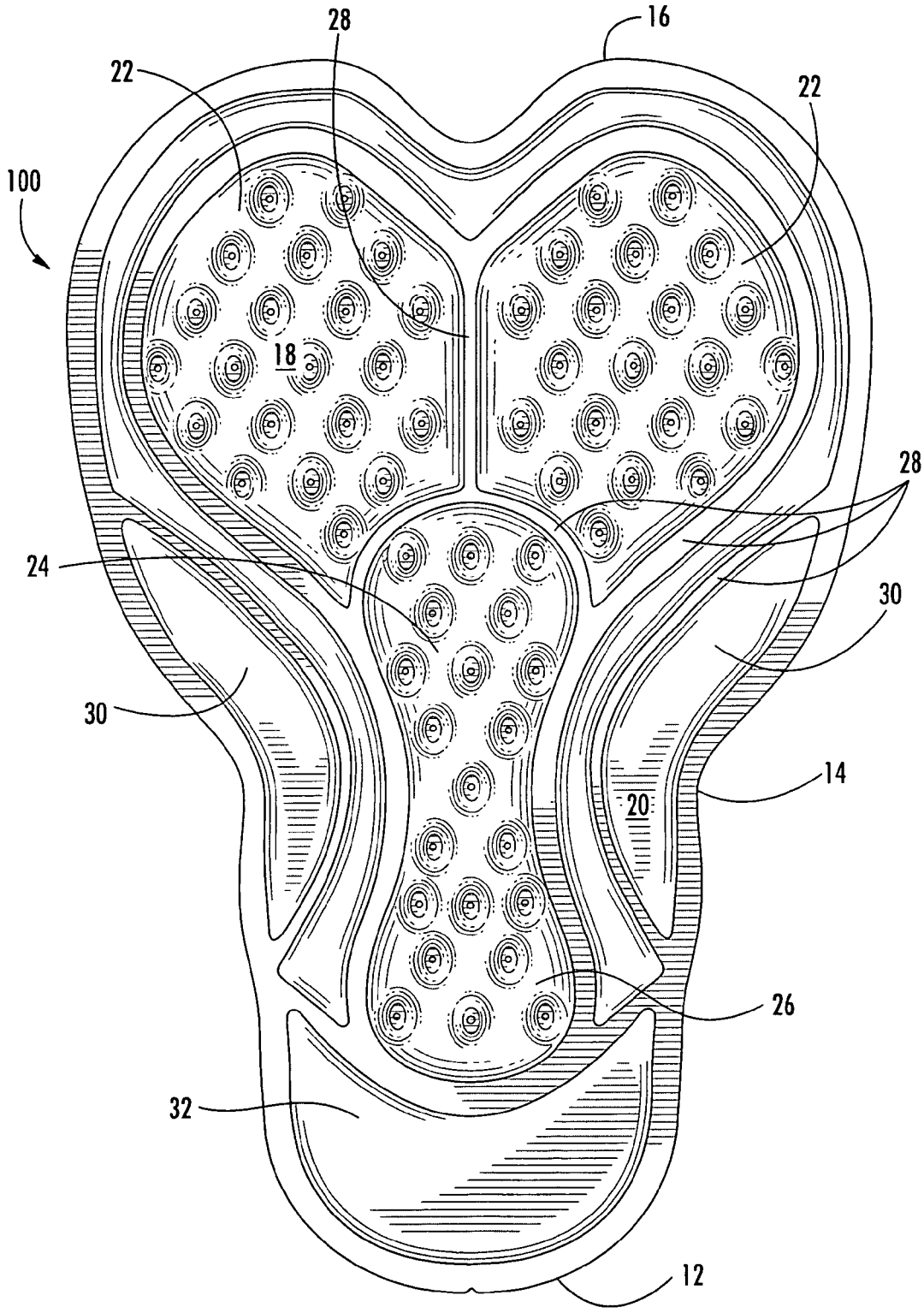
FIG. 12 is a top plan view of the seat pad of FIG. 11.
Figure 13A:
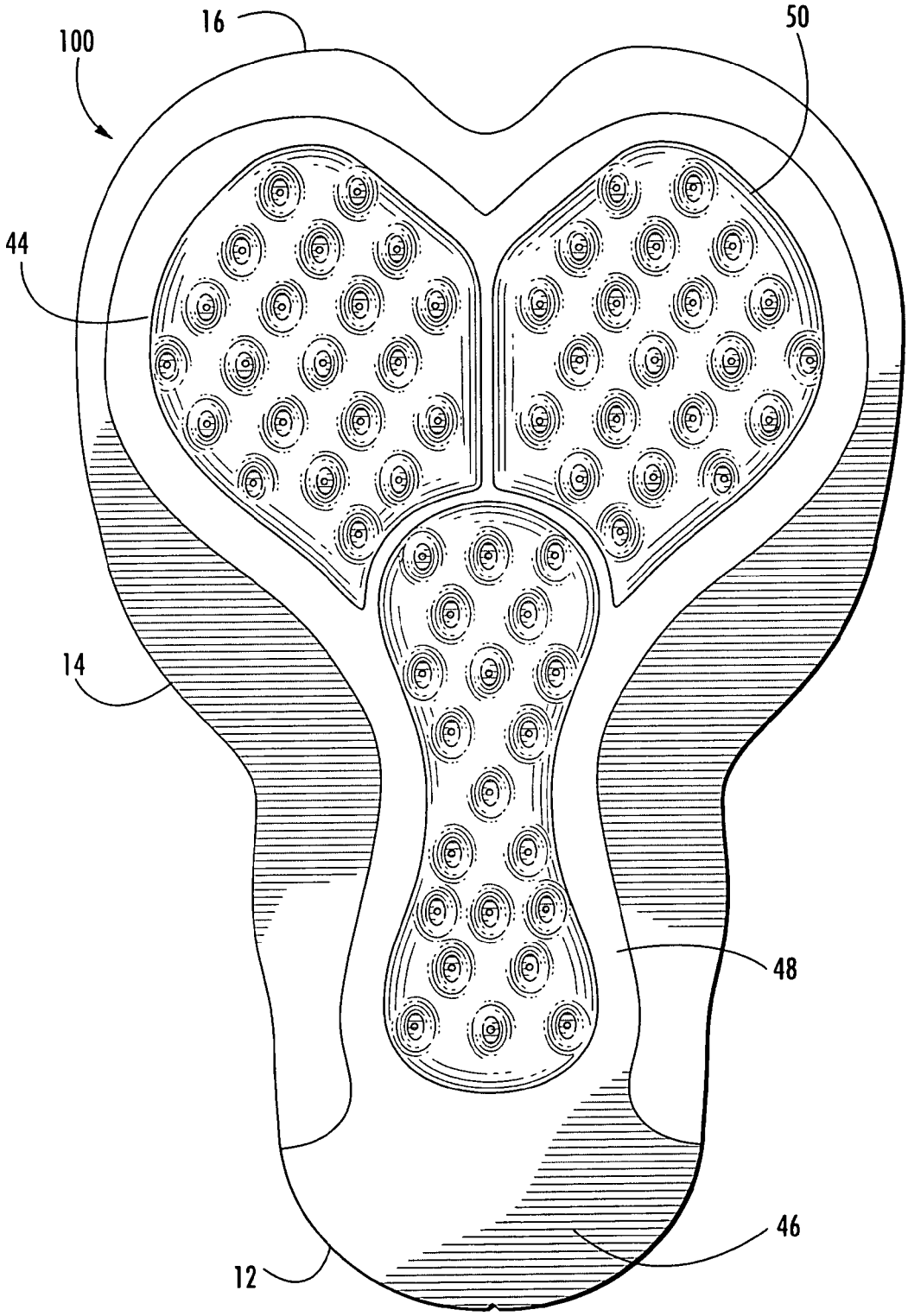
FIG. 13*a* is bottom plan view of the seat pad of FIG. 11 in one embodiment of the invention.
Figure 13B:
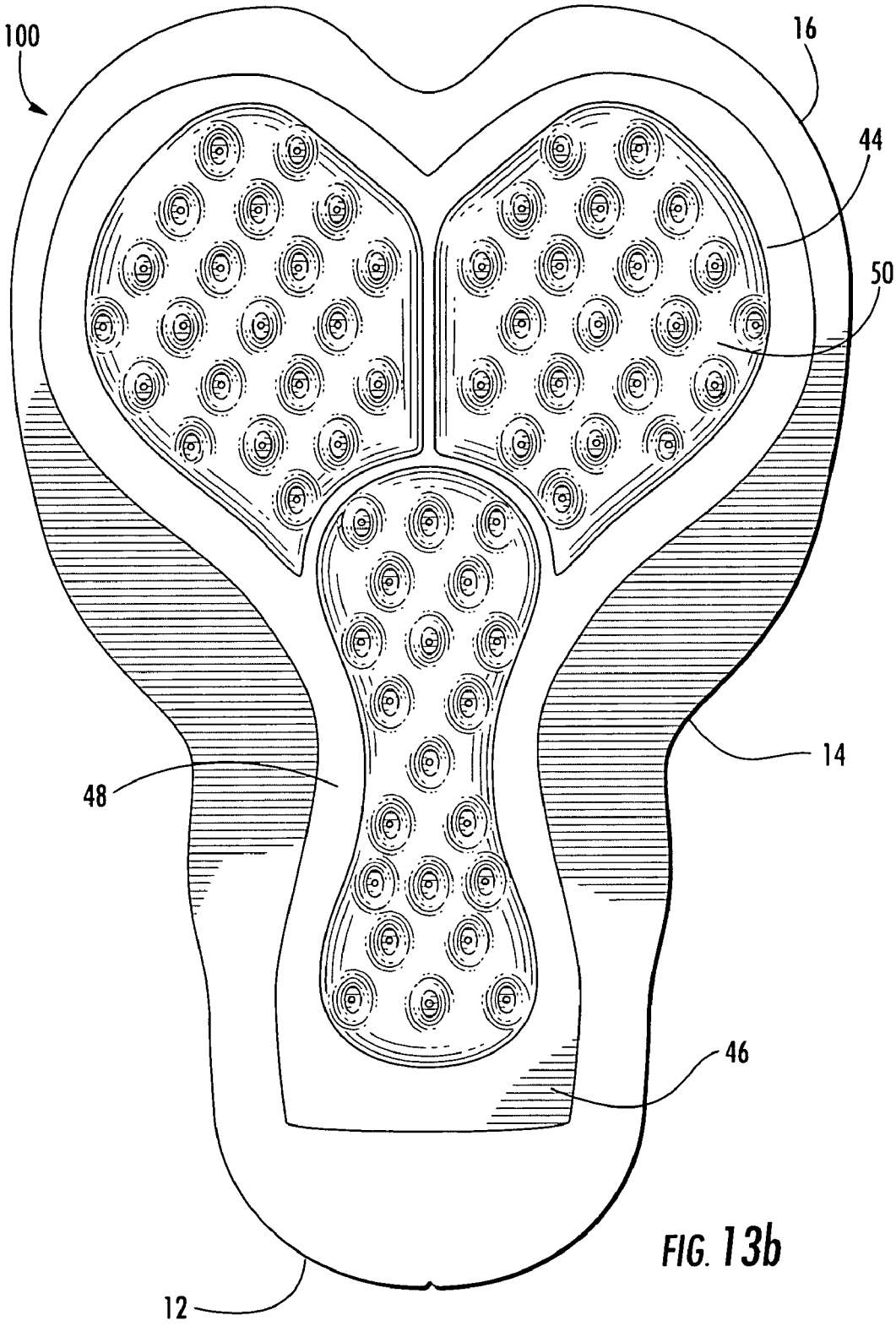
FIG. 13*b* is a bottom plan view of the seat pad of FIG. 11 in another embodiment of the invention.

FIGS. 11-13 show a seat pad 100 in another embodiment of the invention. The seat pad 100 is generally a padded, multi-layered substantially planar element intended to be disposed in a cycling garment for providing a female cyclist with enhanced comfort while sitting upon and riding a bicycle or the like. The elements of the seat pad 100 are identical, in many respects, to those disclosed and discussed above with respect to the seat pad 10. Elements consistent in the seat pads 10 and 100 are indicated by consistent reference numerals.

The seat pad 100 includes the front portion 12, the intermediate portion 14 and the rear portion 16. The seat pad 100 includes, generally, the same shape as the seat pad 10. However, the seat pad 100 is somewhat smaller than the seat pad 10. Specifically, the front portion 12 and the intermediate portion 14 of the seat pad 100 are generally narrower than those of the seat pad 10. Further, the front portion 14 of the seat pad 100 does not extend as far as that of the seat pad 10. That is, lower abdominal portion 32 of the seat pad 100 is narrower and does not extend as far as that of the seat pad 10.

The seat pad 100 further includes less hinge lines 28 than the seat pad 10. However, the hinge lines 20 of the seat pad 100 are disposed similarly as those of the seat pad 10 to provide the pad 100 with the desired flexibility.

The seat pad 100 comprises the same multilayer structure discussed above with respect to the seat pad 10. It is noted that, as with the seat pad 10, the middle and outer layers 42, 44 of the seat pad 100 are differently shaped and smaller than the inner layer 40. Preferably, all of the inner, middle, and outer layers 40, 42, and 44 are uniquely sized and shaped with respect to one another, all three layers overlapping only proximate the central region 18. It is particularly noted that the outer layer 44, which fixes the seat pad 100 to the cycling garment, does not complement or otherwise correspond to the inner layer 40.

Despite the similarities of the seat pads 10 and 100, the seat pad 100 includes thickness generally less than the corresponding thicknesses of the seat pad 10. Particularly, the seat pad 100 includes a thickness at the central area 18 of approximately six to ten millimeters and, more specifically, includes a thickness of approximately eight millimeters. The thickness of the seat pad 100 at the outer area upper thigh portions 30 of the outer area 20 is approximately one to five millimeters and, particularly, is approximately three millimeters. The thickness of the seat pad 100 at the lower abdominal portion 32 of the outer area 20 is approximately three to eight millimeters and, more preferably, is approximately five millimeters.

The differences in size and thickness of the seat pad 100 with respect to the seat pad 10 accounts for the unique details and requirements of the female anatomy. Still, the seat pad 100 is thickest at the central area 18 in order to provided the cyclist with maximum support and padding in this region. The pad 100 is thinner at the outer area 20, particularly at the upper thigh portions 30, to reduce bulkiness of the seat pad and to increase the flexibility and comfort properties thereof.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A multi-layer seat pad for a cyclist garment, comprising:
an inner layer for contacting the cyclist;
an outer layer for affixing to the garment; and
a compressible, resilient middle layer disposed between the outer and inner layers;
wherein the inner layer and/or the middle layer delimits an outer perimeter of the seat pad;
wherein the outer layer covers less than all of the inner layer so as to be disposed out of contact with a portion of the outer perimeter; and
wherein the middle layer is fixed to at least one of the inner and outer layers such that the middle layer is immovable relative to the respective inner and outer layer.

2. The multi-layer seat pad of claim 1, wherein the outer layer includes a shape and a size different than a shape and a size of the inner layer such that the outer layer does not complement the inner layer.

3. The multi-layer seat pad of claim 2, wherein the outer layer includes a width less than a width of the inner layer.

4. The multi-layer seat pad of claim 2, wherein the outer layer includes a length less than a length of the inner layer.

5. The multi-layer seat pad of claim 1, wherein the inner layer includes a thigh portion for contacting a thigh area of the cyclist and wherein the outer layer does not cover the thigh portion of the inner layer such that the thigh portion is affixed directly to the garment.

6. The multi-layer seat pad of claim 1, wherein the inner layer comprises a rear portion and an opposite front portion having a width less than that of the rear portion, the rear portion for contacting a buttocks region of the cyclist and the front portion for contacting a crotch and lower abdominal region of the cyclist.

7. The multi-layer seat pad of claim 6, wherein the outer layer is a generally planar, elongate member which does not complement a size and/or shape of the inner layer.

8. The multi-layer seat pad of claim 1, further comprising a plurality of perforations formed through the seat pad so as to traverse through the inner, middle, and outer layers.

9. The multi-layer seat pad of claim 8, wherein the perforations each comprise a recess inset into a thickness of the seat pad and a hole formed through the seat pad at the recess.

10. The multi-layer seat pad of claim 8, wherein the perforations are formed through the seat pad in an area corresponding to at least one of a buttocks region and a crotch and a lower abdominal region of the cyclist.

11. The multi-layer seat pad of claim 9, wherein the recess comprises a portion of the inner, middle, and outer layers being permanently compressed.

12. The multi-layer seat pad of claim 9, wherein the recesses comprise first recesses disposed at the inner layer and second recesses disposed at the outer layer, the first and second recesses being disposed oppositely and correspondingly such that the holes traverse through the seat pad from the first recesses to the second recesses.

13. The multi-layer seat pad of claim 1, wherein the middle layer delimits an outer perimeter of the seat pad.

14. The multi-layer seat pad of claim 1, wherein the inner and outer layers comprise a woven cloth-like material and the middle layer comprises a foam material including a plurality of foam layers, one of the foam layers extending beyond the outer layer to cover substantially all of the inner layer.

15. The multi-layer seat pad of claim 1, wherein the inner, middle, and outer layers are fixed together such that the seat pad comprises a generally planar elongated member having a front end and an opposing rear end, the rear end being wider than the front end.

16. The multi-layer seat pad of claim 15, further comprising:

a central area for contacting a buttocks and a crotch of the cyclist, the central area extending from the rear end towards the front end of the seat pad and being disposed centrally about a longitudinal axis of the seat pad; and an outer area for contacting an upper thigh of the cyclist, the outer area being disposed around the central area.

17. The multi-layer seat pad of claim 16, wherein the central area includes a thickness greater than a thickness of the outer area, and the outer layer extends across an entirety of the central area and the outer layer extends across only a portion of the outer area.

18. The multi-layer seat pad of claim 1, further comprising a permanently compressed area of the inner, middle, and outer layers formed as a line for providing flexibility to the seat pad.

19. The multi-layered seat pad of claim 1, wherein the outer layer includes a surface area of approximately 50-90% of a surface area of the inner layer.

20. The multi-layered seat pad of claim 1, wherein the outer layer includes a surface area of approximately 60-80% of a surface area of the inner layer.

21. The multi-layered seat pad of claim 1, wherein the outer layer includes a surface area of approximately 70-80% of a surface area of the inner layer.

22. The multi-layered seat pad of claim 1, wherein the outer layer includes a surface area of approximately 75% of a surface area of the inner layer.

23. A cycling garment, comprising:

a crotch portion to be worn proximate a crotch area of a cyclist; and a multi-layer seat pad disposed at the crotch portion for engaging the crotch area of the cyclist, the seat pad including an inner layer for contacting the cyclist, an outer layer for affixing to the garment, and a compressible, resilient middle layer disposed between the outer and inner layers, wherein the inner layer and/or the middle layer delimits an outer perimeter of the seat pad, and wherein the outer layer covers less than all of the inner layer so as to be disposed out of contact with a portion of the outer perimeter;

wherein the middle layer is fixed to at least one of the inner and outer layers such that the middle layer is immovable relative to the respective inner and outer layer.

24. The cyclist garment of claim 23, wherein the garment comprises cycling pants or shorts and wherein the inner layer comprises an upper thigh portion for contacting an upper thigh area of a cyclist, the outer layer being shaped and sized so as not to be disposed on the upper thigh portion such that the upper thigh portion affixes directly to the garment.

25. A method of manufacturing a multi-layer seat pad for a cyclist garment, comprising:

forming an inner layer for contacting the cyclist;

forming a compressible, resilient middle layer;

affixing the middle layer on the inner layer;

delimiting an outer perimeter of the seat pad with the inner layer and/or the middle layer;

forming an outer layer for affixing to the garment;

affixing the outer layer on the inner layer over the middle layer such that the outer layer covers less than all of the inner layer and such that the outer layer is disposed out of contact with a portion of the outer perimeter; and fixing the middle layer to at least one of the inner and outer layers such that the middle layer is immovable relative to the respective inner and outer layer.

26. The method of manufacturing a multi-layer seat pad for a cyclist garment of claim 25, further comprising forming a plurality of perforations through the seat pad such that each perforation traverse through the inner, middle, and outer layers.

27. The method of manufacturing a multi-layer seat pad for a cyclist garment of claim 26, wherein the forming of the perforations comprises forming permanently compressed areas on the seat pad and then punching a hole through the seat pad at the permanently compressed area.

28. The method of manufacturing a multi-layer seat pad for a cyclist garment of claim 25, further comprising forming at least one thinned hinge line on the seat pad to provide flexibility thereto.

29. A seat pad for a cyclist garment, comprising:

an inner layer for contacting a cyclist; and a compressible, resilient layer bonded to the inner layer;

wherein the inner layer delimits an outer perimeter of the seat pad; and wherein the compressible resilient layer covers less than all of the inner layer so as to be disposed out of contact with a portion of the outer perimeter and wherein the bonded inner layer and compressible, resilient layer are fixed to the cyclist garment; and wherein the compressible, resilient layer is fixed to the inner such that the compressible, resilient layer is immovable relative to the inner layer.

30. The seat pad of claim 29, further comprising ventilation holes extending through the seat pad, the holes being inset into a surface of the seat pad.

31. The seat pad of claim 29, wherein the inner layer includes upper thigh portions for contacting a thigh of the cyclist, the compressible, resilient layer being shaped and sized so as not to be disposed on the upper thigh portions such that the upper thigh portions affix directly to the garment.

32. The multi-layered seat pad of claim 29, further comprising an outer layer adjacent to the compressible, resilient layer, wherein the outer layer includes a surface area of approximately 50-90% of a surface area of the inner layer.

33. The multi-layered seat pad of claim 29, further comprising an outer layer adjacent to the compressible, resilient layer, wherein the outer layer includes a surface area of approximately 60-80% of a surface area of the inner layer.

34. The multi-layered seat pad of claim 29, further comprising an outer layer adjacent to the compressible, resilient layer, wherein the outer layer includes a surface area of approximately 70-80% of a surface area of the inner layer.

35. The multi-layered seat pad of claim 29, further comprising an outer layer adjacent to the compressible, resilient layer, wherein the outer layer includes a surface area of approximately 75% of a surface area of the inner layer.

36. A seat pad for a cyclist garment, comprising:

a first side;

an opposing second side; and perforations formed through the seat pad so as to traverse from the first side to the second side;

wherein the first side delimits an outer perimeter of the seat pad and the second side covers less than all of the first side so as to be disposed out of contact with a portion of the outer perimeter; and wherein a middle layer is fixed to at least one of the first and second sides such that the middle layer is immovable relative to the respective first and second sides.

37. The seat pad of claim 36, wherein the perforations each comprise a recess inset into at least one of the first and second sides of the seat pad and a hole formed through the seat pad at the recess.

38. The seat pad of claim 37, wherein the recess comprises a permanently compressed portion of the seat pad.

39. The seat pad of claim 36, wherein the perforations comprise first recesses disposed at the first side and second recesses disposed at the second side, the first and second recesses being disposed oppositely and correspondingly such that holes traverse through the seat pad from the first recesses to the second recesses.

40. The seat pad of claim 36, wherein the perforations are formed through the seat pad in an area corresponding to a buttocks region of the cyclist.

41. The seat pad of claim 36, wherein the perforations are formed through the seat pad in an area corresponding to a crotch and a lower abdominal region of the cyclist.

* * * * *